US006134802A

United States Patent [19]

Alberhasky et al.

[11] Patent Number: 6,134,802

[45] Date of Patent: Oct. 24, 2000

[54] WIRE OR CABLE DRYING SYSTEM WITH WATER SEPARATOR

[75] Inventors: Craig A. Alberhasky, Ralston; Scott L. Karstens, Gretna, both of Nebr.

[73] Assignee: Lucent Technologies Inc., Murray Hill, N.J.

[21] Appl. No.: 09/417,573

[22] Filed: Oct. 14, 1999

[51] Int. Cl.[7] ..... F26B 13/30

[52] U.S. Cl. ..... 34/92

[58] Field of Search ..... 34/92, 107, 625

[56] References Cited

U.S. PATENT DOCUMENTS 3,808,846 5/1974 Fleissner ..... 68/19.1

5,377,425 1/1995 Kawakami et al. ..... 34/92

5,819,436 10/1998 Helevirta ..... 34/408

*Primary Examiner*—William Doerrler

*Assistant Examiner*—Malik N. Drake

*Attorney, Agent, or Firm*—James J. Bitetto

[57] ABSTRACT

An apparatus for drying cable, in accordance with the present invention includes a trench formed longitudinally on a plate for receiving a cable whereby a plurality of openings formed in the trench permit fluid communication therethrough such that water present on the cable is removed through the openings by evacuation. A water separator is coupled to the bottom portion for receiving the evacuated water and separating out the water by gravity.

22 Claims, 5 Drawing Sheets

WIRE OR CABLE DRYING SYSTEM WITH WATER SEPARATOR

BACKGROUND OF THE INVENTION

1. Field of the Invention

The present invention relates to insulated wire fabrication, and more particularly to a wire drying system which employs a water separator to separate water from air to prevent water from entering a vacuum pump.

2. Description of the Related Art

Insulated wires may include one or more layers of insulation over a cable core, a stranded or solid conductor core or a fiber optic core. Insulated wires are manufactured by drawing the core through an extruder which includes a plastic melt at high pressure and temperature. The extruder provides an insulation coating on the core which adheres to the core and has a substantially uniform thickness around the core. Plastics such as polyvinyl chloride, polyethylene or equivalent plastics are employed as insulation.

As the wire or cable is drawn from the extruder, the plastic insulation begins to cool. However, this plastic insulation is often still at the high temperature of the extruder plastic. Since plastic is a good thermal insulator, it takes a long time to cool to room temperature in air. The cable or wire is typically drawn through the extruder at a rate of about 1100 feet per minute. It is preferable to spool the wire or cable as soon as possible to maintain the manufacture rate. Therefore, in-line cooling techniques are employed.

The most commonly employed techniques includes passing the wire or cable through a cool water bath to increase heat transfer from the insulation material. One drawback of this technique is the need to dry off the wire or cable prior to spooling the wire or cable. This is typically performed by spraying high pressure air on the cable to blow the water off. Spraying the cable or wire with air jets is often noisy since the jets include spray nozzles which can cause noise levels as high as 90 decibels, and require hearing protection from operating personnel.

Another technique includes vacuuming the wire or cable to suck the water away from the wire or cable. This technique causes the cable or wire to be sucked down into a trough where the vacuum suction causes wear due to friction on the cable as well as wear of the metallic surfaces of the trough. Further, since the vacuum is sucking away the water, the vacuum pumps of conventional system often take in water which seriously compromises the pump life.

Therefore, a need exists for a water drying apparatus which avoids excessive wear on the cable and a vacuum trough employed to draw away water on the cable. A further need exists for a water separator which prevents water intake to the vacuum pump during operations.

SUMMARY OF THE INVENTION

An apparatus for drying cable, in accordance with the present invention includes a trench formed longitudinally on a plate for receiving a cable whereby a plurality of openings formed in the trench permit fluid communication therethrough such that water present on the cable is removed through the openings by evacuation. A water separator is coupled to the bottom portion for receiving the evacuated water and separating out the water by gravity.

Another apparatus for drying cable, in accordance with the present invention, includes a trough disposed within a vacuum chamber for receiving a horizontally disposed portion of cable. The trough divides the chamber into a top portion and a bottom portion. A trench is formed longitudinally along the trough and facing into the top portion. The trench for receives the cable. The trough includes a liner in the trench to prevent wear of the trench and the cable as the cable moves relative to the trench. A plurality of openings are formed in the trench to permit fluid communication between the top portion and the bottom portion such that when the bottom portion is evacuated water present on the cable is removed through the openings. A water separator is coupled to the bottom portion for receiving the evacuated water and separating out the water by gravity. The water separator includes a vertical drain pipe for receiving the water and maintaining an amount of water therein having a weight at least equal to a vacuum pull force such that the water is prevented from entering a vacuum pump having an intake at a topmost vertically disposed location on the water separator.

Another apparatus for drying cable, in accordance with the present invention, includes a cable guiding device adapted to transfer a cable along a straight horizontal path. A vacuum chamber is disposed about the straight horizontal path. A trough is disposed within the vacuum chamber for dividing the chamber into a top portion and a bottom portion. The trough includes a trench formed longitudinally thereon which faces into the top portion. The trench receives the cable, and the trough includes a liner in the trench to prevent wear of the trench and the cable. A plurality of openings are formed in the trench to permit fluid communication between the top portion and the bottom portion such that when the bottom portion is evacuated water present on the cable is removed through the openings. A water separator is coupled to the bottom portion for receiving the evacuated water and separating out the water by gravity. The water separator includes a vertical drain pipe for receiving the water and maintaining an amount of water thereon having a weight at least equal to a vacuum pull force such that the water is prevented from entering a vacuum pump having an intake at a topmost vertically disposed location on the water separator.

An apparatus for removing water from a vacuum intake, in accordance with the invention includes a vacuum source for drawing in water from a vacuum chamber, and a water separator. The water separator includes a vacuum tight tube, and the tube includes a port for receiving the water drawn from the vacuum chamber. The port is oriented such that water received therein flows about an interior surface of the tube and is drawn downwardly by gravity. A drain pipe in the tube receives the water drawn downwardly. The drain pipe has a vertical length such that a column of water maintained in the drain pipe vacuum seals the tube and provides a weight capable of counter balancing a vacuum force supplied at a topmost vertical position on the tube by the vacuum source such that water in the tube is prevented from entering the vacuum source having an intake at a topmost vertically disposed location on the tube.

In alternate embodiments, the liner may include a ceramic material, such as Alumina Titanium. The water separator may include a tube having an intake port therein for receiving the water such that water entering the tube is drawn downwardly in a helical flow into the drain pipe. The tube may be transitioned into the drain pipe by a funnel. The funnel may include baffles disposed therein to disturb the helical flow. The drain pipe may be connected to a tank having an output port to drain off the water.

These and other objects, features and advantages of the present invention will become apparent from the following detailed description of illustrative embodiments thereof, which is to be read in connection with the accompanying drawings.

BRIEF DESCRIPTION OF DRAWINGS

The invention will be described in detail in the following description of preferred embodiments with reference to the following figures wherein.

DETAILED DESCRIPTION OF PREFERRED EMBODIMENTS

The present invention relates to insulated wire fabrication, and more particularly to a wire drying system which employs a water separator to separate water from air to prevent water from entering a vacuum pump. The invention provides a ceramic lined vacuum trough insert which advantageously reduces friction when vacuuming water off of the cable. The vacuumed off air and water is then introduced to a water separator which prevents water from entering a vacuum pump which creates the vacuum to draw off the water. The water separator is connected between the vacuum pump and to the vacuum trough.

Water and air drawn through the vacuum trough are introduced into a round cavity of the water separator. Water in the separator spins about the interior circumference of the cavity and is drawn down into a funnel by gravity. The funnel is in communication with a water line or pipe which begins to fill with water. The water line or pipe has a height sufficient to prevent the water therein from being drawn into the vacuum pump which has its intake at a high position on the water separator. Advantageously, the water separator is passive, that is, requires no power, and significantly increases vacuum pump life.

Figure 1:
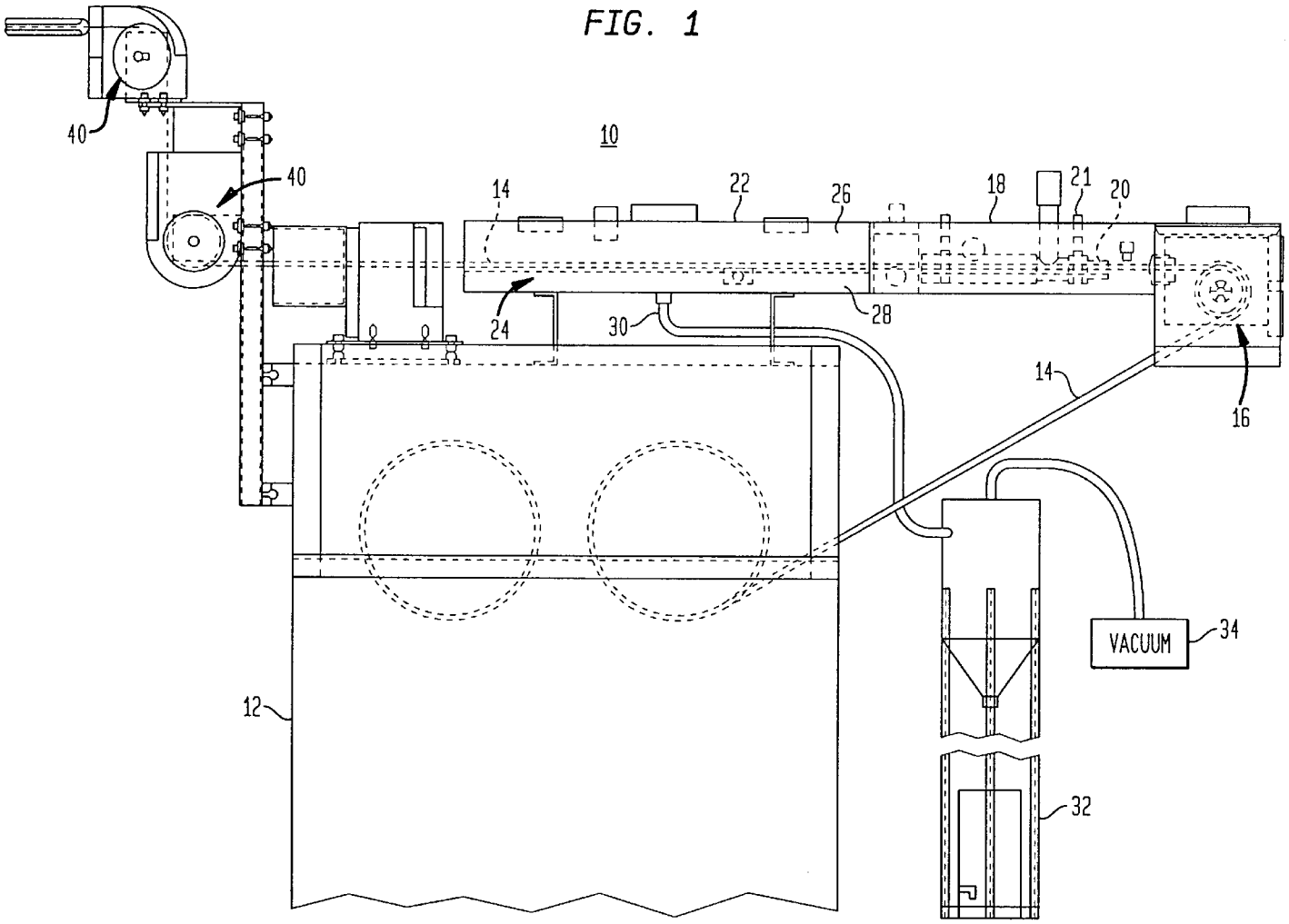
FIG. 1 is a front view of a cable drying apparatus in accordance with the present invention.

Referring now to the drawings in which like numerals represent the same or similar elements and initially to FIG. 1, a cable/wire drying apparatus 10 is shown in accordance with one embodiment of the present invention. The present invention will be described in terms of cable. For all intents and purposes of this disclosure cable means a core having an insulation coating, layer or cover formed thereon. The core may include a stranded or solid conductor, such as Aluminum or Copper, for example. The core may also include an optical fiber, strength members other wires of cables or any combinations thereof. A wet capstan 12 is employed to pull cable 14 and provide sufficient tension in cable 14 for applying the present invention. Wet capstan 12 may wet cable 14 by employing sprayers or water nozzles and supplies cable 14 to a pulley 16. Cable 14 may be cooled by exposure to water prior to and/or during wet capstan 16 tensioning.

From pulley 16, cable 14 may be tested for concentricity. A concentricity tester 20 is shown which, for example, ultrasonically scans cable 14 to determine insulation thickness thereon using ultra sonic transducers in assembly 18. Concentricity tester 20 is not necessary for the practice of the present invention; however, concentricity tester 20 is conveniently placed at this location since cable 14 is preferably submerged in water while ultrasonically testing cable 14.

After concentricity tester 20, cable 14 enters a vacuum chamber 22. Vacuum chamber 22 includes a cable trough 24 which divides chamber 22 into a top portion 26 and a bottom portion 28. Bottom portion 28 includes a vacuum port 30 for connecting to a water separator 32 in accordance with the present invention. Water separator 32 will be described in greater detail with reference to FIG. 2. Water separator 32 is, in turn, connected to a vacuum pump 34 used for maintaining vacuum in bottom portion 28 of chamber 22. Cable 14 is passed over trough 24 and water is drawn away from cable 14 thereby drying cable 14.

Trough 24 is surfaced with a friction-reducing material which reduces friction between cable 14 and trough 24. (See FIG. 4). Trough 24 preferably includes a friction-reducing insert that may be replaced periodically without disturbing or replacing other components of the system. When cable 14 passes over trough 24, cable 14 is drawn toward trough 24. Suction through trough 24 causes contact between trough 24 and cable 14 and applies a normal force against cable 14. This increases friction and therefore wear in conventional systems. By surfacing trough 24 with a reduced friction material, such as a polished ceramic, wear and friction are significantly reduced. In a preferred embodiment, trough 24 is removable from chamber 22 and can be replaced easily.

After vacuum drying cable 14, cable proceeds on to other testing or measurement equipment and then to a level winder (not shown) for spooling. A plurality of pulleys 40 are employed to direct cable 14 and maintain cable tension thereon for handling and winding procedures.

Figure 2:
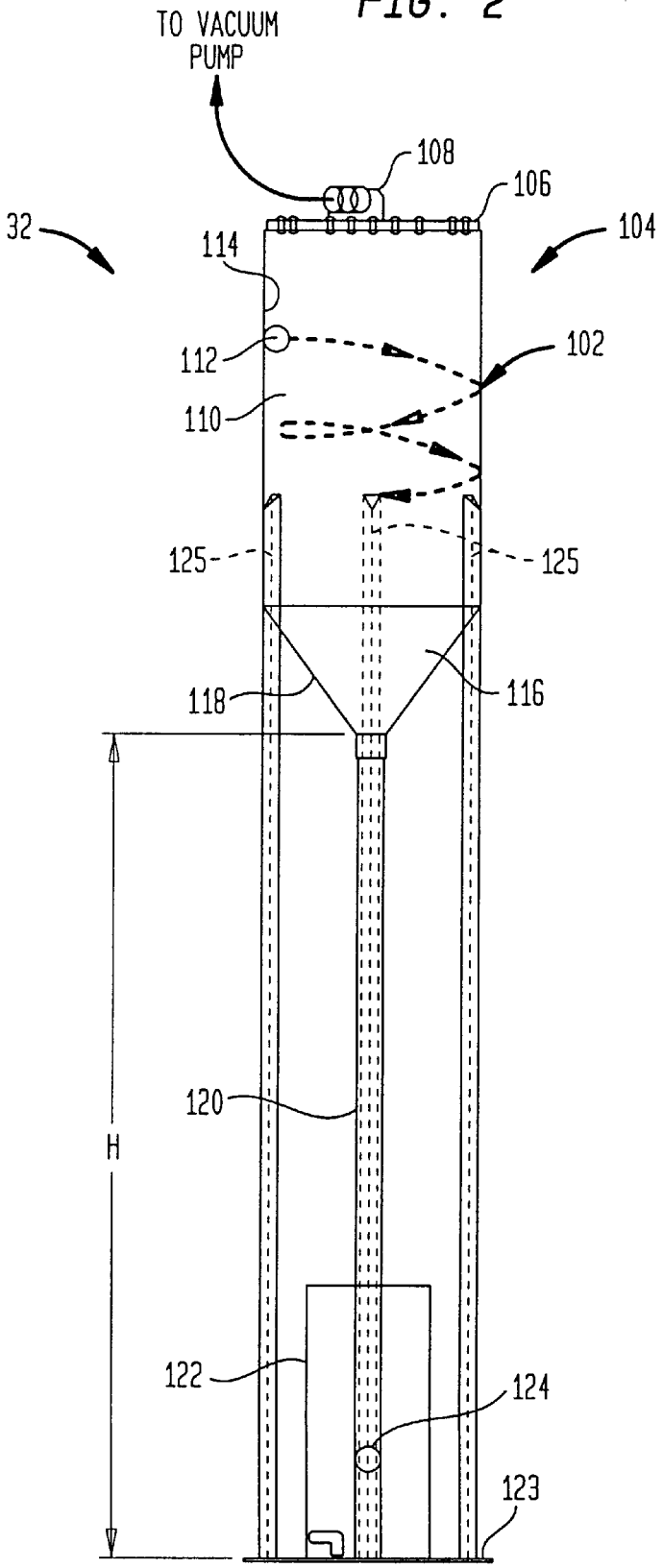
FIG. 2 is a front view of a water separator for separating water from a vacuum intake in accordance with the present invention.

Referring to FIG. 2, water separator 32 is illustratively shown in greater detail in accordance with the present invention. Water separator 32 preferably includes a tube 102 preferably having a circular cross-section. Tube 102 includes a top portion 104 and a cover 106. Cover 106 provides a vacuum tight interface with top portion 104 of tube 102. A vacuum intake port 108 is installed through cover 106 for drawing air from an interior cavity 110 of tube 102 during operation. Another port 112 is formed through a sidewall of tube 102. Port 112 is oriented to tangentially introduce a water/air flow from bottom portion 28 of chamber 22 (FIG. 1) into cavity 110 of tube 102. In this way, an interior surface 114 of tube 102 functions as a vane for directing water about its interior surface.

Water is directed about the circular interior of tube 102 and begins spinning helically downward and in contact with interior surface 114 due to centrifugal force on the fluid. Baffles 116, which are attached to an interior surface of a funnel 118, disturb the flow of water. Baffles 116 or other collecting device permit water flow into a tube or pipe 120. Water fills pipe 120 and provides a seal to prevent air from entering cavity 110 in top portion 104 of tube 102. The water column formed in pipe 120 includes a height, H, sufficient to ensure that water is not drawn into vacuum intake port 108. This is achieved by providing a water column of sufficient weight to counter act the vacuum pull in the vertical direction (i.e., against gravity). In preferred embodiments, height H may be between about 50 to 70 inches high for a pump rated at about 15 to about 35 vacuum inches of water.

Pipe 120 may exit to a tank 122 or be drained by a drain tube 124. Advantageously, the present invention provides separation between air and water such that water is prevented from entering vacuum pump 34. This significantly increases the useful life of the pump and ensures the reliability of the manufacturing line. A pump failure requires the manufacturing line to be stopped. Any stoppage of a continuous manufacturing line directly correlates to lost revenue. The present invention ensures proper suction for vacuum pump 34 in a vacuum dry cable process.

Tube 102, interior surface 114, baffles 116, funnel 118 and pipe 120 are preferably fabricated from a corrosion resistant material. For example, these components may be made from plastics, glass, metals, such as stainless steel, etc. These components may further include combinations of corrosion resistant materials.

It is to be understood that the water separator of the present invention may be employed in a plurality of different applications which employ vacuum drying and may benefit from the use of the water separator. It is further contemplated that the water separator of the present invention may be employed with other liquids to separate these liquids from a gas. The structure of the present invention is illustrative and may be varied depending on the application.

Water separator 32 may include a stand 123 and supports 125 (which are exterior to tube 102), be suspended or mounted in its vertical position by a plurality of different methods.

Figure 3:
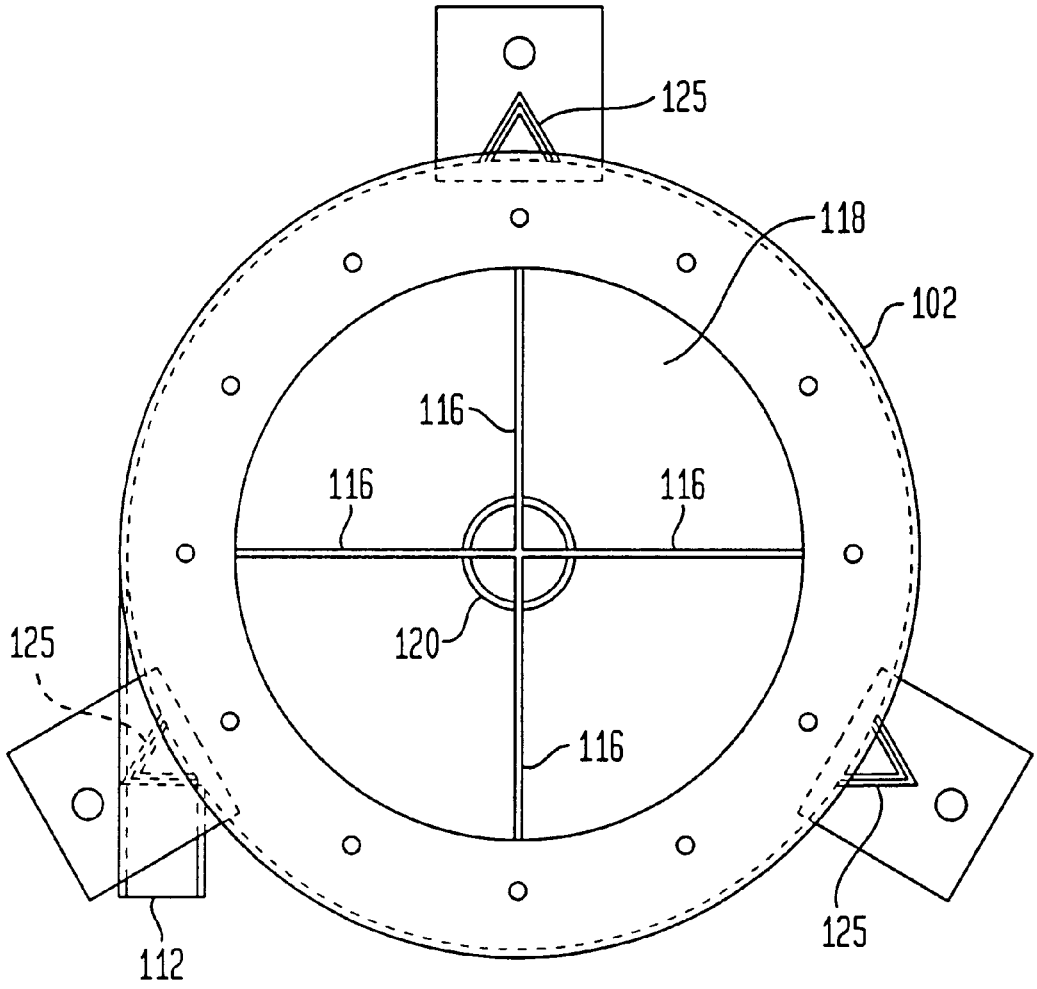
FIG. 3 is a top view of a funnel having a baffle installed therein in accordance with the present invention.

Referring to FIG. 3, a to view of funnel 118 is shown. Baffles 116 are installed in funnel 118 to disturb the flow of liquid through funnel 118. The disrupted flow advantageously increases flow rate through funnel 118. Other baffle configurations are contemplated as well.

Figure 4:
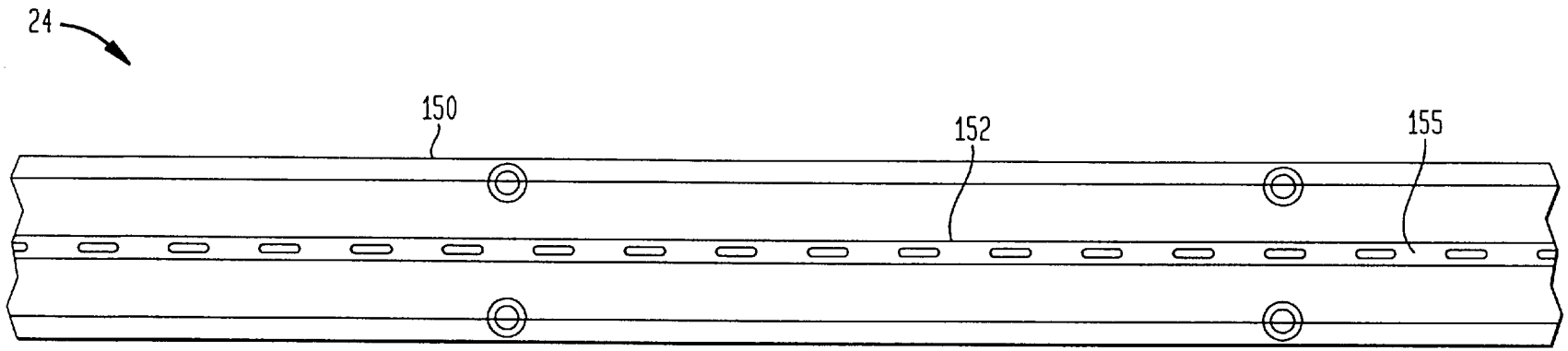
FIG. 4 is a top view of a trough employed for cable drying in accordance with the present invention.
Figure 5A:
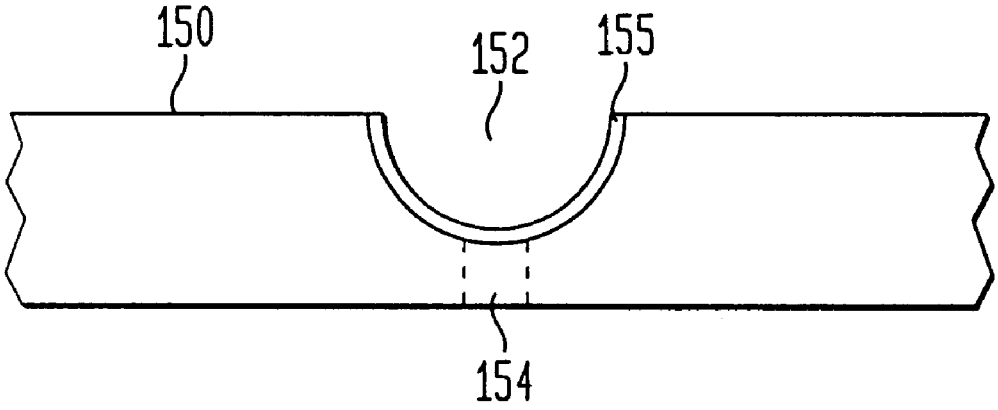
FIGS. 5A and 5B show cross-sectional views of a trough with different trench shapes in accordance with the present invention.
Figure 5B:
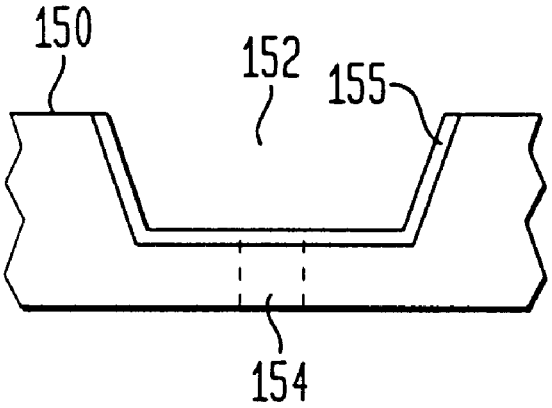

Referring to FIG. 4, trough 24 is shown in greater detail. Trough 24 includes a plate 150 having a trench 152 formed along its length. Trench 152 communicates with a plurality of slots 154 formed through plate 150. Trench 152 may include for example, a semicircular shape as shown in FIG. 5A, or a triangular shape as shown in FIG. 5B, or other shapes such as a rectangular shape. Surface of trench 152 is treated or surfaced by forming a friction-reduced surface thereon using a material 155. In a preferred embodiment, the surface of trench 152 is lined with a ceramic material, such as Alumina Titanium; other ceramics may also be employed. Material 155 preferably includes a thickness of between about 6 and 12 mils if ceramics are employed although other thicknesses may also be employed. Material 155 may preferably include a microfinish of between about 24 to about 32 micron inches (Arithmetic Average). Material 155 may be applied as a prefabricated insert which includes a preformed shape. The insert may be installed in trench 152, such that insert of material 155 includes slots 154 therethrough. If an insert is used, the insert may be adapted to fit trench 152 and provide for an appropriate shape and dimensions for a cable being processed. In this way, trough 24 achieves versatility as different cable sizes can be accommodated. Further, maintainability is achieved by permitting worn inserts of material 155 to be easily replaced. Plate 150 may include a material resistant to corrosion due to water such as, for example, stainless steel.

Trough 24 may include a length sufficient to adequately dry cable 14 (FIG. 1). In one embodiment, cable 14 travels at a rate of about 1110 feet per minute. Trough 24, in this instance, has an adequate length at about 36 inches. One skilled in the art would understand that this length may be changed in accordance with system needs.

Slots 154 are disposed at intervals along the bottom of trench 152. Slots 154 are sized to provide sufficient suction from vacuum to remove water from cable 14 (FIG. 1). In one embodiment, slots 154 may include elongated holes which have a diameter of about 0.08 inches to about 0.1 inches (i.e., slot thickness), and the slots 154 may be between about 0.2 to about 0.4 inches in length. These dimensions may be altered based on the mount of water to be removed and the suction available from the vacuum pump.

Having described preferred embodiments of wire or cable drying system with water separator (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. An apparatus for drying cable comprising:

a trench formed longitudinally on a plate for receiving a cable whereby a plurality of openings formed in the trench permit fluid communication therethrough such that water present on the cable is removed through the openings by evacuation; and a water separator coupled to the bottom portion for receiving the evacuated water and separating out the water by gravity.

2. The apparatus as recited in claim 1, wherein the water separator includes a vertical drain pipe for receiving the water and maintaining an amount of water therein having a weight at least equal to a vacuum pull force such that the water is prevented from entering a vacuum pump having an intake at a topmost vertically disposed location on the water separator.

3. The apparatus as recited in claim 1, wherein the plate is disposed within a vacuum chamber, the trench in the plate for receiving a horizontally disposed portion of the cable and dividing the vacuum chamber into a top portion and a bottom portion wherein the bottom portion is evacuated to draw the water present on the cable through the openings.

4. The apparatus as recited in claim 1, wherein the trench includes a liner to prevent wear of the trench and the cable as the cable moves relative to the trench.

5. The apparatus as recited in claim 4, wherein the liner includes a ceramic material.

6. The apparatus as recited in claim 5, wherein the ceramic material includes Alumina Titanium.

7. The apparatus as recited in claim 1, wherein the water separator includes a tube having an intake port therein for receiving the water such that water entering the tube is drawn downwardly in a helical flow into a drain pipe.

8. The apparatus as recited in claim 7, wherein the tube is transitioned into the drain pipe by a funnel.

9. The apparatus as recited in claim 8, wherein the funnel includes baffles disposed therein to disturb the helical flow.

10. The apparatus as recited in claim 7, wherein the drain pipe is connected to a tank having an output port to drain off the water.

11. An apparatus for drying cable comprising:

a cable guiding device adapted to transfer a cable along a straight horizontal path;

a vacuum chamber disposed about the straight horizontal path;

a trough disposed within the vacuum chamber for dividing the chamber into a top portion and a bottom portion, the trough including a trench formed longitudinally therein and facing into the top portion, the trench for receiving the cable, the trough including a liner in the trench to prevent wear of the trench and the cable;

a plurality of openings formed in the trench to permit fluid communication between the top portion and the bottom portion such that when the bottom portion is evacuated water present on the cable is removed through the openings; and a water separator coupled to the bottom portion for receiving the evacuated water and separating out the water by gravity, the water separator including a vertical drain pipe for receiving the water and maintaining an amount of water thereon having a weight at least equal to a vacuum pull force such that the water is prevented from entering a vacuum pump having an intake at a topmost vertically disposed location on the water separator.

12. The apparatus as recited in claim 11, wherein the liner includes a ceramic material.

13. The apparatus as recited in claim 12, wherein the ceramic material includes Alumina Titanium.

14. The apparatus as recited in claim 11, wherein the water separator includes a tube having an intake port therein for receiving the water such that water entering the tube is drawn downwardly in a helical flow into the drain pipe.

15. The apparatus as recited in claim 14, wherein the tube is transitioned into the drain pipe by a funnel.

16. The apparatus as recited in claim 15, wherein the funnel includes baffles disposed therein to disturb the helical flow.

17. The apparatus as recited in claim 11, wherein the drain pipe is connected to a tank having an output port to drain off the water.

18. An apparatus for removing water from a vacuum intake comprising:

a vacuum source for drawing in water from a vacuum chamber;

a water separator comprising:

a vacuum tight tube, the tube including a port for receiving the water drawn from the vacuum chamber, the port being oriented such that water received therein flows about an interior surface of the tube and is drawn downwardly by gravity;

a drain pipe in the tube for receiving the water drawn downwardly, the drain pipe having a vertical length such that a column of water maintained in the drain pipe vacuum seals the tube and provides a weight capable of counter balancing a vacuum force supplied at a topmost vertical position on the tube by the vacuum source such that water in the tube is prevented from entering the vacuum source having an intake at a topmost vertically disposed location on the tube.

19. The apparatus as recited in claim 18, wherein tube has a circular cross-section and water entering the tube from the port is drawn downwardly in a helical flow.

20. The apparatus as recited in claim 18, wherein the tube is transitioned into the drain pipe by a funnel.

21. The apparatus as recited in claim 20, wherein the funnel includes baffles disposed therein to disturb the helical flow.

22. The apparatus as recited in claim 18, wherein the drain pipe is connected to a tank having an output port to drain off the water.

* * * * *